US006753833B2

(12) United States Patent
Seo et al.

(10) Patent No.: US 6,753,833 B2
(45) Date of Patent: Jun. 22, 2004

(54) DRIVING METHOD OF PDP AND DISPLAY DEVICE

(75) Inventors: Yoshiho Seo, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 69 days.

(21) Appl. No.: 09/981,970

(22) Filed: Oct. 19, 2001

(65) Prior Publication Data

US 2003/0016192 A1 Jan. 23, 2003

(30) Foreign Application Priority Data

Jul. 17, 2001 (JP) ..... 2001-216271

(51) Int. Cl.[7] ..... G09G 3/28
(52) U.S. Cl. ..... 345/60; 345/211; 315/169.4
(58) Field of Search ..... 345/60–72; 315/169.1, 315/169.4, 194, 199; G09G 3/28

(56) References Cited

U.S. PATENT DOCUMENTS 6,466,186 B1 * 10/2002 Shimizu et al. ..... 345/60

6,483,250 B1 * 11/2002 Hashimoto et al. ..... 315/169.4

* cited by examiner

*Primary Examiner*—Richard Hjerpe
*Assistant Examiner*—Alexander Eisen
(74) *Attorney, Agent, or Firm*—Staas & Halsey LLP

(57) ABSTRACT

A method for driving a PDP is provided in which power loss is reduced and light emission efficiency is improved while applying a voltage pulse train so as to generate display discharge whose number of times corresponds to luminance in cells to be lighted. A drive step of one pulse for generating one time of display discharge includes steps of supplying current to a pair of display electrodes of the cells to be lighted from a drive power source so as to charge capacitance between the display electrodes so that voltage between the display electrodes exceeds display discharge start voltage and cutting off a current path between the display electrode pair and the drive power source at least in a part of a period from start to end of the display discharge.

18 Claims, 12 Drawing Sheets

DRIVING METHOD OF PDP AND DISPLAY DEVICE

BACKGROUND OF THE INVENTION

1. Field of the Invention

The present invention relates to a method and a device for driving a plasma display panel (PDP).

Increasing number of pixels in a PDP due to a large screen or a high definition cause increase of power consumption. It is necessary to reduce the power consumption for reducing load of a driving device and for taking measures against heat.

2. Description of the Prior Art

As a color display device, a surface discharge AC type PDP is commercialized. The surface discharge type has electrodes (display electrodes X and display electrodes Y) to be anodes and cathodes in display discharge for ensuring luminance. The display electrodes X and Y are arranged on a front substrate or a back substrate in parallel, and address electrodes (third electrodes) are arranged so as to cross the display electrode pairs. There are two forms of display electrode arrangement. In one form, a pair of display electrodes is arranged for each row of a matrix display. In another form, display electrodes X and display electrodes Y are arranged alternately at a constant pitch. In the latter form, each of the display electrodes except both ends of the arrangement works for displays of two neighboring rows. Regardless of the arrangement form, the display electrode pairs are covered with a dielectric layer.

In a surface discharge type PDP display, one of the display electrodes (pair) assigned to each row is used as a scan electrode for row selection, so as to generate address discharge between the scan electrode and the address electrode, and address discharge between the display electrodes triggered by the address discharge between the scan electrode and the address electrode. In this way, addressing is performed for controlling electrification quantity (wall charge quantity) of the dielectric layer in accordance with display contents. After addressing, sustain voltage (also called drive voltage) Vs having alternating polarity is applied to the display electrode pair. The sustain voltage Vs satisfies inequality (1).

$$Vf_{XY}-Vw_{XY}<Vs<Vf_{XY} \quad (1)$$

Here, $Vf_{XY}$ denotes discharge start voltage between the display electrodes, and $Vw_{XY}$ denotes wall voltage between the display electrodes.

When the sustain voltage Vs is applied, cell voltage (sum of drive voltage applied to the electrode and the wall voltage) exceeds the discharge start voltage $Vf_{XY}$ only in the cell having a predetermined quantity of the wall charge so that surface discharge is generated on the substrate surface for a display. As an application period is shortened, light emission can be observed as if it is continuous.

A discharge cell of the PDP is basically a binary light emission element. Therefore, a half tone is realized by setting an integral light emission quantity of each discharge cell in a frame period in accordance with a gradation value of input image data. The color display is a type of the gradation display, and a display color is determined by a combination of luminance values of three primary colors. As a gradation display, there is used a method in which a frame is made of plural subframes (subfields for an interlace display) having a luminance weight, and the integral light emission quantity is set by a combination of on and off of the light emission for each subframe. A general driving sequence is as follows. A subframe period that is assigned to each subframe includes a reset period for equalizing charge distribution of the screen, an address period for forming the charge distribution in accordance with display contents, and a display period (or a sustain period) for generating display discharge (or sustain discharge) of the number of times in accordance with the gradation value by applying a pulse train having alternating polarities. Though lengths of the reset period and the address period are constant regardless of the luminance weight, a length of the display period is longer as the luminance weight is larger.

In the conventional driving method, a sustain pulse Ps having a simple rectangular waveform with an amplitude Vs is applied to a display electrode X and a display electrode Y alternately in the display period as shown in FIG. 17. In other words, the display electrode X and the display electrode Y are temporarily biased to potential Vs alternately. Thus, the pulse train having alternating polarities is applied across the display electrode X and the display electrode Y (refereed to as an interelectrode XY). The difference between a pulse base potential (usually the ground level GND) and the bias potential, which is the sustain voltage Vs, is set to a value within a drive margin. The drive margin is defined as a difference between the discharge start voltage Vf and the minimum applied voltage Vsm necessary for sustaining a lighted state. If the sustain voltage Vs is the voltage Vf and above, the discharge is generated also in cells that were not lighted in the addressing period. If the sustain voltage Vs is less than Vsm, a lighted cell becomes a non-lighted state.

Since cells of the PDP are capacitive load for a power source, current flows so as to charge capacitance (CP) of the cell when the sustain pulse Ps is applied. Usually, the display discharge is generated with some delay after the terminal voltage of the capacitance reaches the sustain voltage Vs, while discharge current (referred to as light emission current) flows simultaneously. In the conventional method, the discharge current is supplied to the cell from a power source circuit connected to the PDP. For this reason, a path for supplying the power is long and passes many circuit devices such as switching transistors, so there was a problem of a large power loss and thereby degrading efficiency of the light emission.

SUMMARY OF THE INVENTION

An object of the present invention is to reduce the power loss and to increase the efficiency of the light emission.

According to the present invention, capacitance between display electrodes is charged sufficiently for generating display discharge, and after that a current path between a power source and a cell is cut off. Values of charge voltage and charge period are set so that the cut-off timing and the display discharge are overlapped. When display discharge is generated in the cut-off period, the discharge current is supplied to a discharge gap from the charged capacitance. In this case, a path of the discharge current that flows more rapidly than the charge current to the capacitance is located within the cell, so a power loss is smaller than the conventional structure in which the discharge current is supplied from the power source.

FIG. 1 shows a basic drive voltage waveform and a discharge current waveform according to the present invention. The drive voltage waveform is characterized by a step-like waveform including a step for applying voltage Vo higher than sustain voltage Vs to the interelectrode XY, a succeeding step of high impedance and a step for applying the sustain voltage Vs. The high impedance step is a step for cutting off power supply from the power source to the cell. The time for applying the voltage Vo from the leading edge of the waveform is denoted by "To", and the time of the high impedance step is denoted by "Td". In this waveform, a lot of power is supplied to capacitance of the interelectrode XY in the early stages by applying the voltage Vo. After that, when discharge is generated, power is consumed for current flowing in discharge gas. If the external power supply is stopped before the discharge finishes, the power for the current flowing in the discharge gas is supplied from the capacitance of the interelectrode XY. After that, the application voltage is set to an appropriate value of voltage Vs before the discharge finishes, so that the wall charge quantity at the end of the discharge is controlled to be suitable for sustaining.

FIG. 2 is a graph showing dependence of efficiency on the voltage Vo. FIG. 3 is a graph showing drive voltage margin. The light emission efficiency depends on a rate of a part of the discharge current that is supplied from the capacitance. It is desirable to set the voltage Vo such that a peak of the discharge current appears during the period for cutting off the electric path. As shown in FIG. 3, sufficient drive margin can be secured even if the voltage Vo is altered. According to the drive waveform of the present invention, a power loss can be reduced without decreasing the drive margin, so that the light emission efficiency can be improved.

DESCRIPTION OF THE PREFERRED EMBODIMENTS

Hereinafter, the present invention will be explained more in detail with reference to embodiments and drawings.

Figure 1:
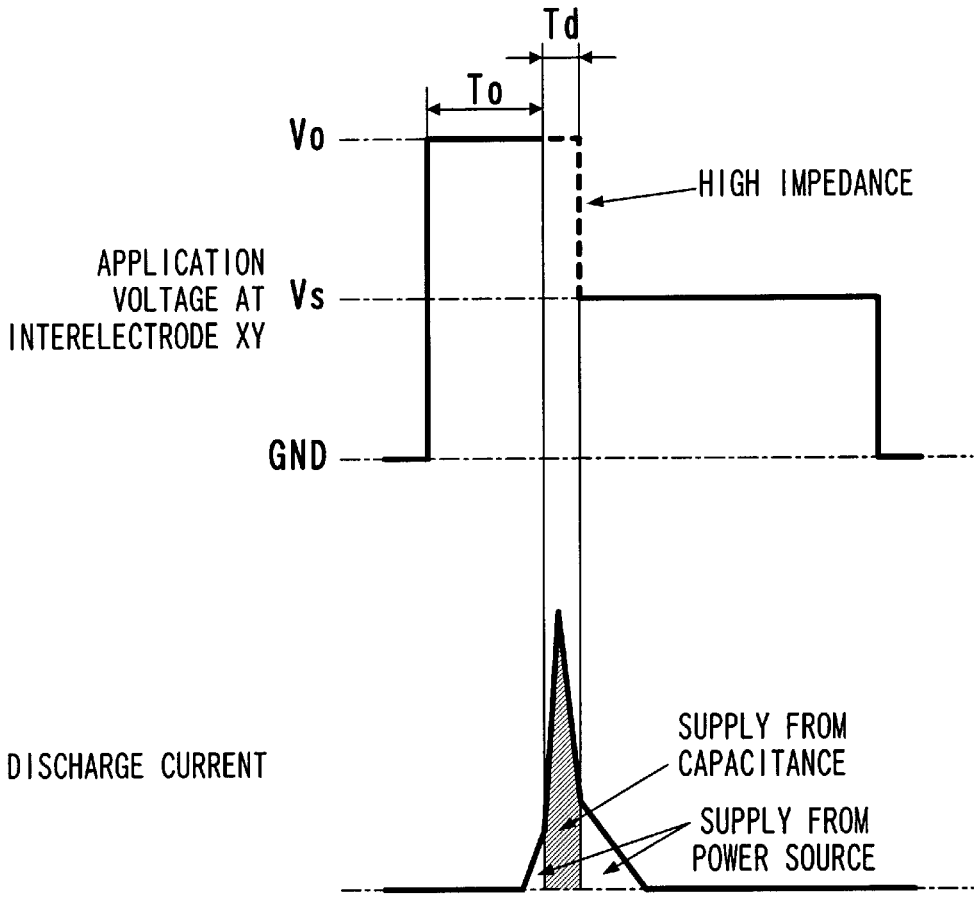
FIG. 1 shows a basic drive voltage waveform and a discharge current waveform according to the present invention.
Figure 2:
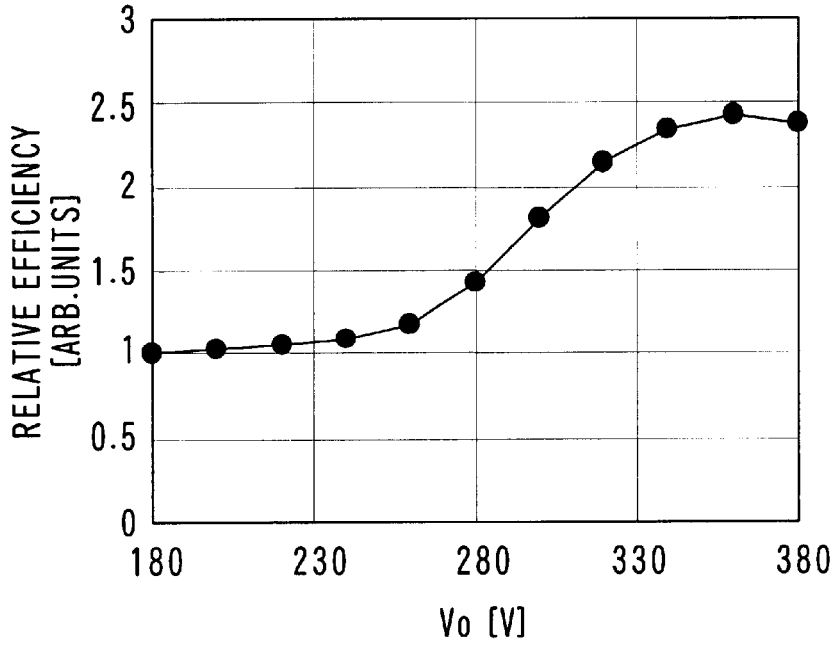
FIG. 2 is a graph showing dependence of efficiency on the voltage Vo.
Figure 3:
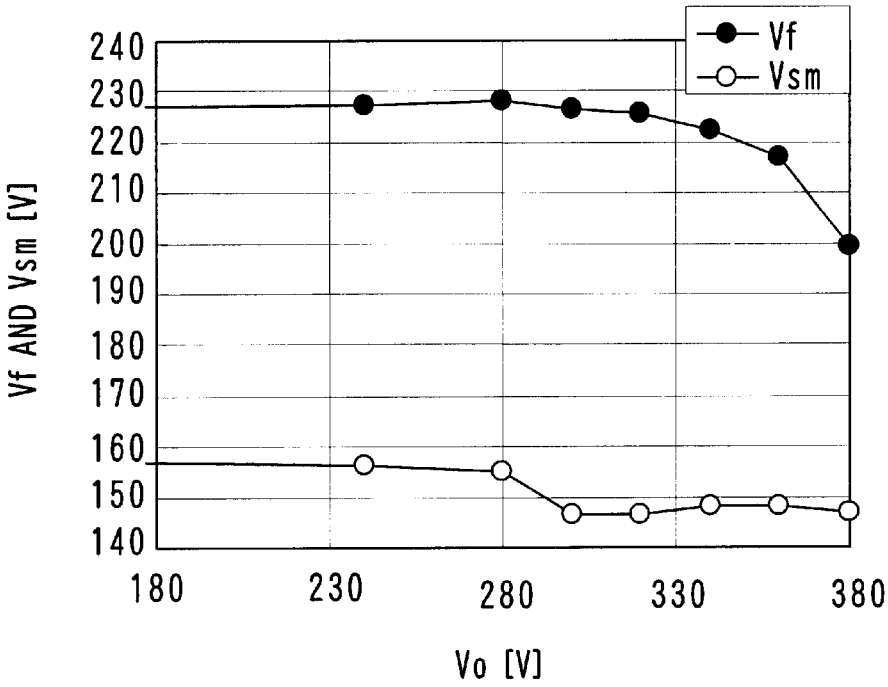
FIG. 3 is a graph showing drive voltage margin.
Figure 4:
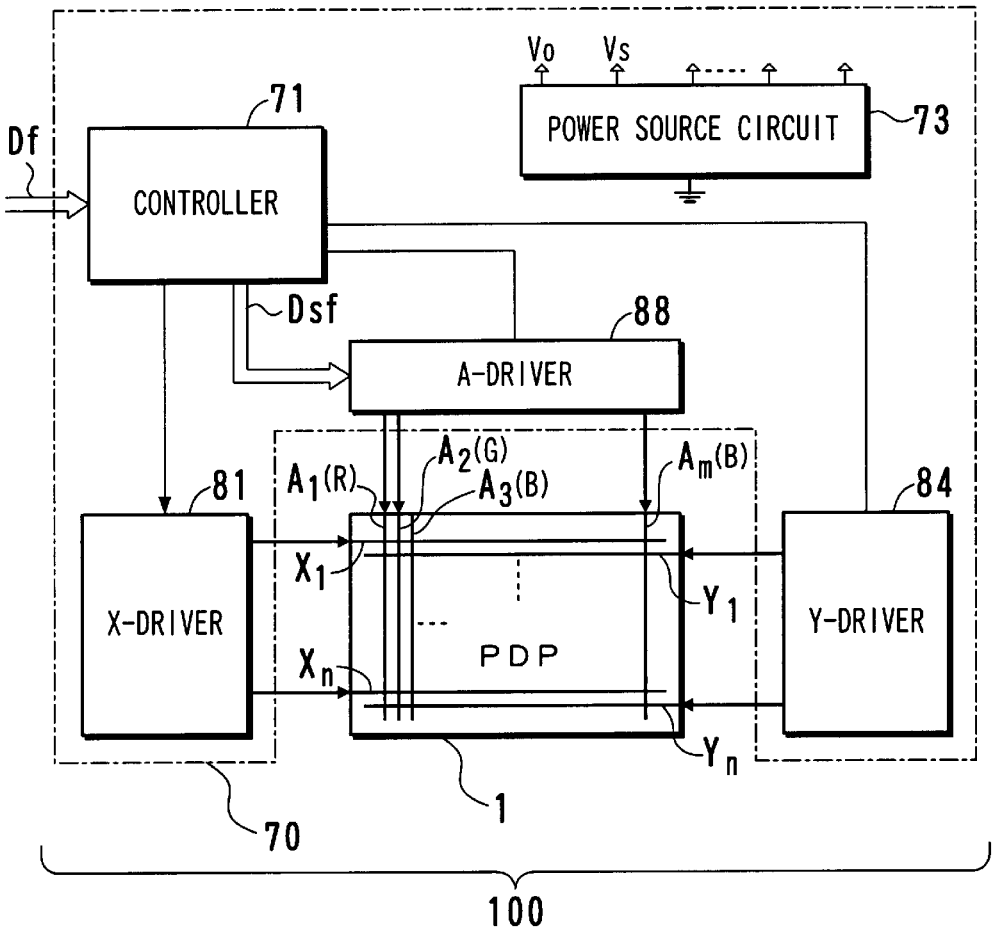
FIG. 4 shows a structure of a display device according to the present invention.

FIG. 4 shows a structure of a display device according to the present invention. The display device 100 comprises a surface discharge type PDP 1 having a color display screen of n rows and m columns, and a drive unit 70 for controlling light emission of cells. The display device 100 is used as a wall-hung television set or a monitor of a computer system.

The PDP 1 comprises a pair of substrate structures 10 and 20. The substrate structure means a structure of a glass substrate on which electrodes and other elements are arranged. The PDP 1 includes display electrodes X and Y that constitute electrode pairs for generating display discharge and are arranged in the same direction, and address electrodes A that are arranged so as to cross the display electrodes X and Y. The display electrodes X and Y extend in the row direction (horizontal direction) of the screen and are covered with a dielectric layer and a protection film. The display electrode Y is used as a scan electrode. The address electrode A extends in the column direction (vertical direction) and is used as a data electrode. In FIG. 4, suffixes (1, n) of the reference numerals of the display electrodes X and Y indicate arrangement orders of the corresponding "rows", while the suffixes (1-m) of the reference numerals of the address electrodes A indicate arrangement orders of the corresponding "columns". The row is a set of cells of the number of columns (m) having the same arrangement order in the column direction, while the column is a set of cells of the number of rows (n) having the same arrangement order in the row direction. In addition, the letters R, G and B in parentheses indicate the light emission color of the cell corresponding to the element having the letter.

The drive unit 70 includes a controller 71, a power source circuit 73, an X driver 81, a Y driver 84 and an A driver 88. The drive unit 70 is supplied with frame data Df that indicate three luminance levels of red (R), green (G) and blue (B) colors along with various kinds of synchronizing signals from external equipment such as a TV tuner or a computer. The frame data Df are memorized temporarily in a frame memory of the controller 71. The controller 71 converts the frame data Df into subframe data Dsf for gradation display, which are sent to the A driver 88. The subframe data Dsf are a set of display data of one bit per cell. The value of each bit indicates on or off of the light emission for a cell in a corresponding subframe, more specifically whether the address discharge is necessary or not. In the case of interlace display, each of fields in a frame is made of plural subfields, and the light emission control is performed for each of the subfield. However, the contents of the light emission control are the same as the case of progressive display.

Figure 5:
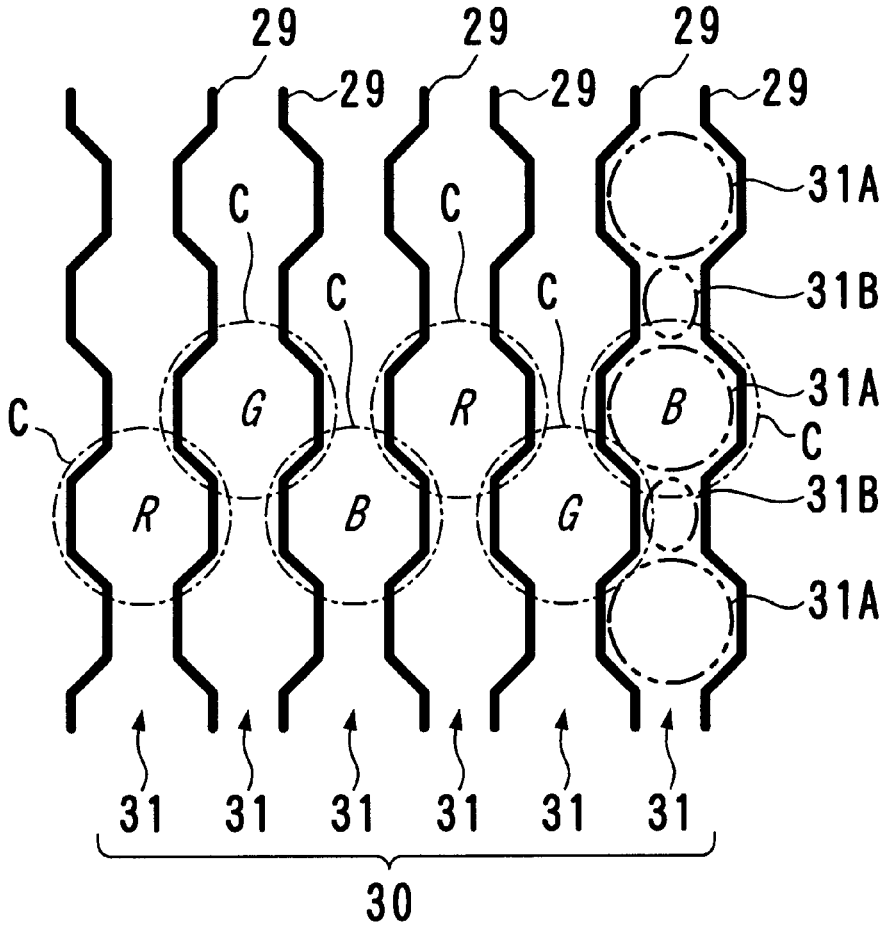
FIG. 5 is a plan view showing a cell arrangement of a display screen.

FIG. 5 is a plan view showing a cell arrangement of a display screen.

In the display screen, a discharge space 30 is divided into plural columns by partitions 29 that meander regularly, so that column spaces 31 having wide portions (the portion in which the width in the row direction is large) 31A and narrow portions (the portion in which the width is small) 31B arranged alternately. In other words, each of the partitions 29 is meandered at a constant pitch and constant amplitude in a plan view, so that the distance between the neighboring partitions 29 becomes smaller than a predetermined value at a constant pitch in the column direction. The predetermined value means a value that can suppress the discharge and is determined by discharge conditions such as a gas pressure. The structure in which the column space 31 between the neighboring partitions is continuous over all rows has some advantages of easy drive by priming for each row, uniformity of film thickness of fluorescent material layers and easy exhaust treatment in a manufacturing process. Since surface discharge is hard to be generated in the narrow portion 31B, the wide portion 31A substantially contributes to the light emission. Therefore, cells are arranged on alternate columns in each row. Noticing two neighboring rows, the column positions of the arranged cells alternate in every column. In other words, the cells are arranged zigzag in both the row direction and the column direction. Each of the cells C is a structure within one wide portion 31A in the display screen. In FIG. 5, five representative cells C are denoted by circles indicated by chain lines (the area of each circle is a bit larger than the real scale to be seen easily). In the PDP 1, three cells of R, G and B colors constitute one pixel, and the arrangement form of three colors in the color display is a triangle (delta) arrangement form. The delta arrangement has an advantage in high definition compared with an inline arrangement since the width of the cell in the row direction is larger than one third of the pixel pitch. In addition, the rate of non-lighted areas in the screen is small, so that high luminance display can be realized. It is not necessary that the horizontal direction is the row direction. The vertical direction can be the row direction while the horizontal direction can be the column direction.

Figure 6:
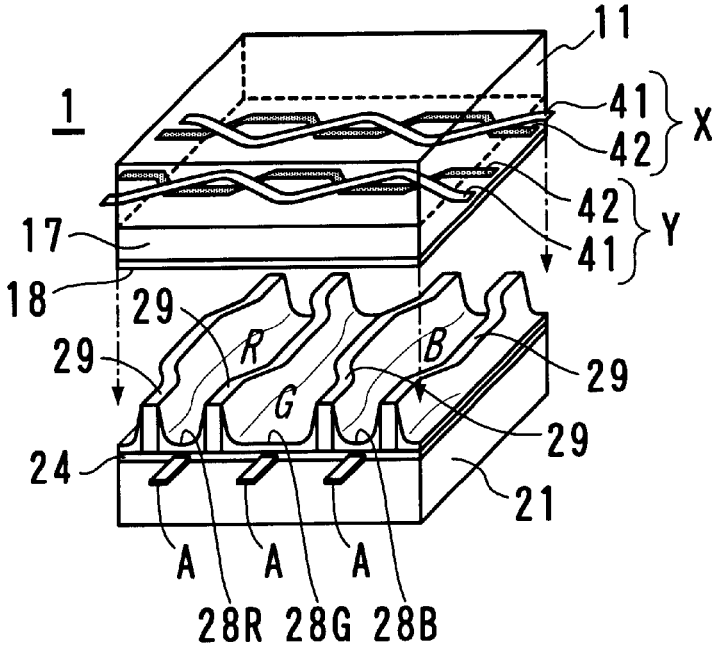
FIG. 6 is a perspective view showing a cell structure of a PDP.

FIG. 6 is a perspective view showing a cell structure of the PDP.

The PDP 1 includes a front glass substrate 11 whose inner surface is provided with the display electrodes X and Y, a dielectric layer 17 and a protection film 18, and a back glass substrate 21 whose inner surface is provided with the address electrodes A, an insulator layer 24, partitions 29 and the fluorescent material layers 28R, 28G and 28B. Each of the display electrodes X and Y includes a transparent conductive film 41 constituting a surface discharge gap and a metal film 42 as a bus conductor. The display electrodes X and Y are arranged alternately at a constant pitch (with the surface discharge gap) in the column direction. The gap direction of the surface discharge gap, i.e., the opposing direction of the display electrodes X and Y is the column direction.

Figure 7:
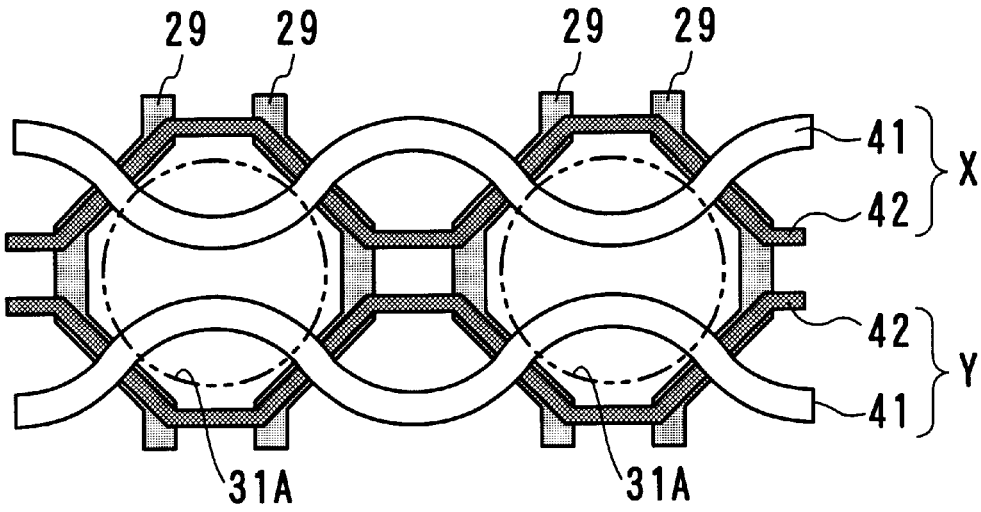
FIG. 7 is a plan view showing a shape of a display electrode.

FIG. 7 is a plan view showing a shape of the display electrode.

Each of the display electrodes X and Y includes a transparent conductive film 41 that extends in the row direction meandering in the column direction and a band-like metal film 42 that extends in the row direction meandering along the partition 29 so as to avoid the wide portion 31A. The transparent conductive film 41 has a curved band-like shape and is patterned in a shape having a gap forming portion arching from the metal film 42 toward the wide portion 31A in each column. In each of the wide portions 31A, the gap forming portion of the display electrode X and the gap forming portion of the display electrode Y face each other, so that a drum-like surface discharge gap is formed. In the pair of gap forming portions facing each other, the opposing sides are not parallel. The width of the band-like transparent conductive film 41 may alter regularly.

This electrode shape enables reduction of the interelectrode capacitance without increasing the surface discharge gap (the minimum distance between electrodes) compared with a linear band-like shape. In addition, since the distance between the transparent conductive film 41 and the metal film 42 is large in the middle of the wide portion 31A in the row direction, the intensity of the electric field in the gap between the transparent conductive film 41 and the metal film 42 decreases, so that a discharge interference between rows can be prevented. In addition, as a side effect, shading effect of the metal film 42 is reduced so that the light emission efficiency increases.

Figure 8:
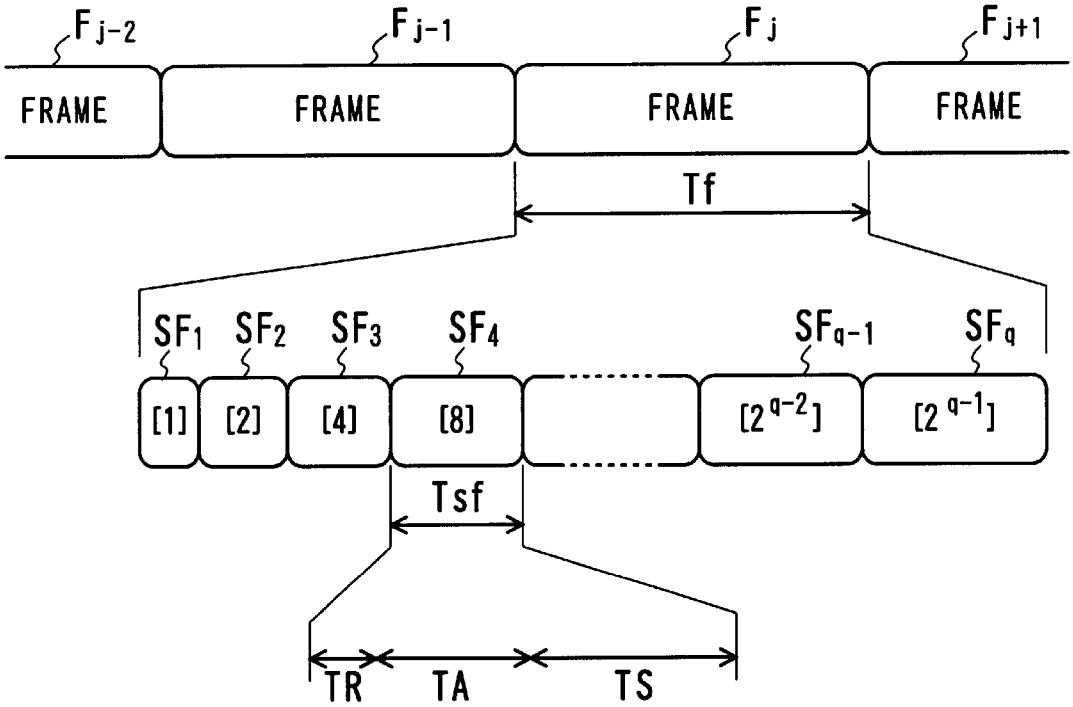
FIG. 8 shows a concept of a frame division.

FIG. 8 shows a concept of a frame division. In a display using the PDP 1, a frame F of the input image data is divided into q subframes SF so that a color is reproduced by on-off control of lighting. In other words, each frame F is replaced with a set of q subframes SF. The subframes SF are provided with weights, e.g., $2^0$, $2^1$, $2^2$, . . . $2^{q-1}$ in order so as to set the number of times of the display discharge in each subframe SF. Though the subframe arrangement is in the weight order in FIG. 8, other order can be adopted. Redundant weighting can be adopted for reducing quasi contour. In accordance with this frame structure, a frame period Tf that is a frame transfer period is divided into q subframe periods Tsf, and one subframe period Tsf is assigned to each subframe SF. In addition, the subframe period Tsf is divided into a reset period TR for initialization, an address period TA for addressing and a display period TS for sustaining. The lengths of the reset period TR and the address period TA are constant regardless of the weight, while the length of the display period TS is longer as the weight is larger. Therefore, the length of the subframe period Tsf is also longer as the weight of the corresponding subframe SF is larger. The driving sequence is repeated for each subframe. The order of the reset period TR, the address period TA and the display period TS is common to each of the q subframes SF.

Hereinafter, drive waveforms in the display period TS, which are relevant to the present invention, will be exemplified.

Figure 9:
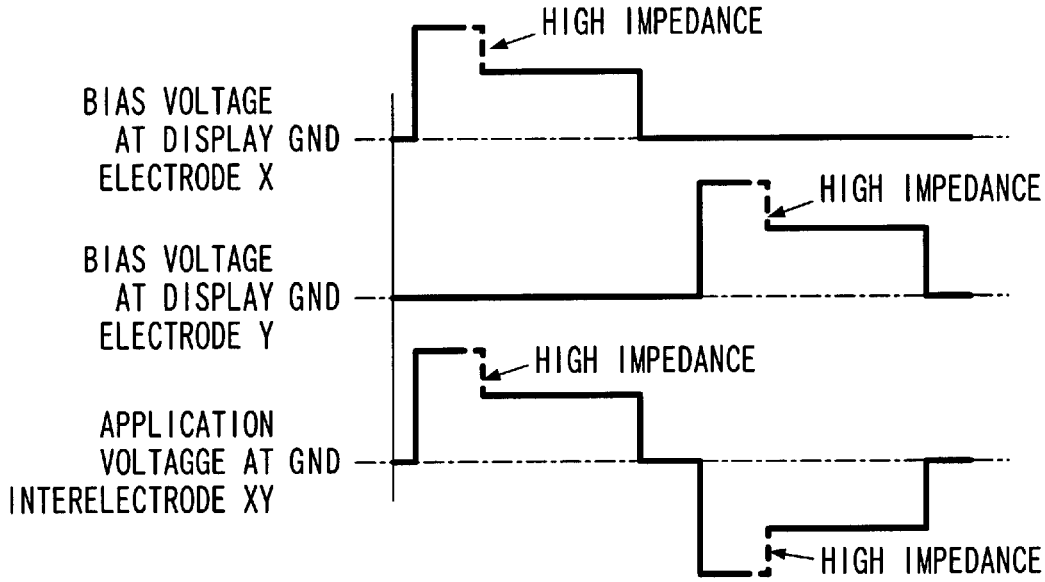
FIG. 9 shows a first example of drive waveforms.

FIG. 9 shows a first example of the drive waveforms. In this example, three kinds of potential, which are positive voltage, lower positive voltage and the ground voltage are set for each of the display electrodes X and Y. The application time of the highest voltage is short, and a high impedance period shown by the broken line is provided at the switching time from the high voltage to the low voltage. Similar drive can be performed by negative low voltage, negative high voltage and the ground level. The application time of the low voltage is short, and a high impedance period may be provided at the switching time from the low voltage to the high voltage. There are two absolute values of potential difference except zero volts at the interelectrode XY in this example. This example has an advantage that only a single output polarity is required in the power source.

Figure 10:
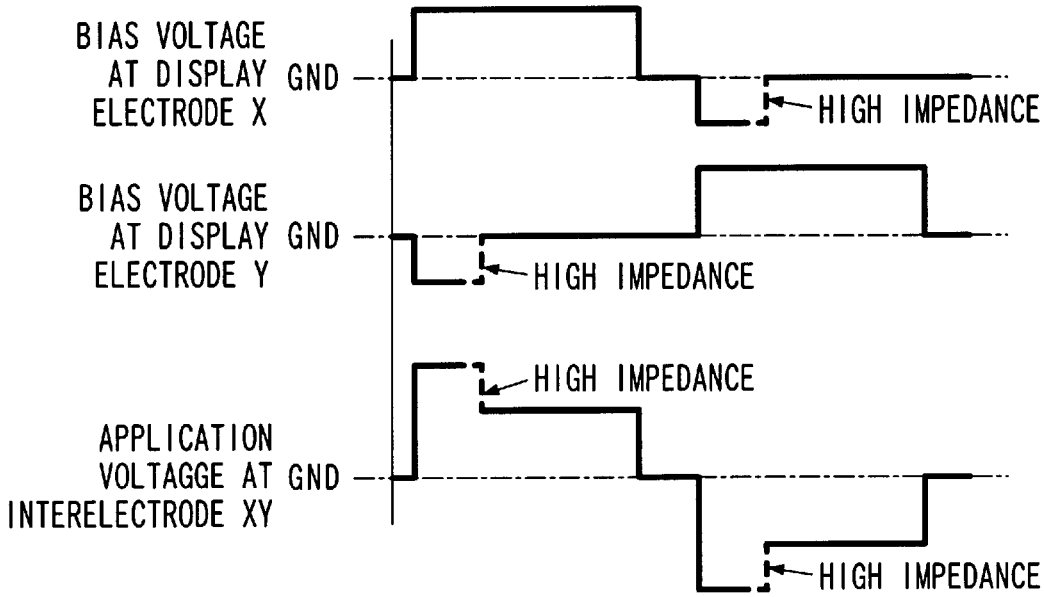
FIG. 10 shows a second example of the drive waveforms.

FIG. 10 shows a second example of the drive waveforms. The drive waveforms in this example have three set potentials including positive voltage, negative voltage and the GND level. The positive voltage is applied to one of the display electrodes X and Y, while the negative voltage is applied to the other. The application time of the negative voltage is short, and the high impedance period is provided at the switching time from the negative voltage to the ground level. In the same way, it is possible to shorten the positive voltage the application time, and to provide the high impedance period at the switching time from the positive voltage to the ground level. There are two absolute values of the potential difference except zero volts at the interelectrode XY. This example has an advantage that the power source can be realized using a device having low withstand voltage.

Figure 11:
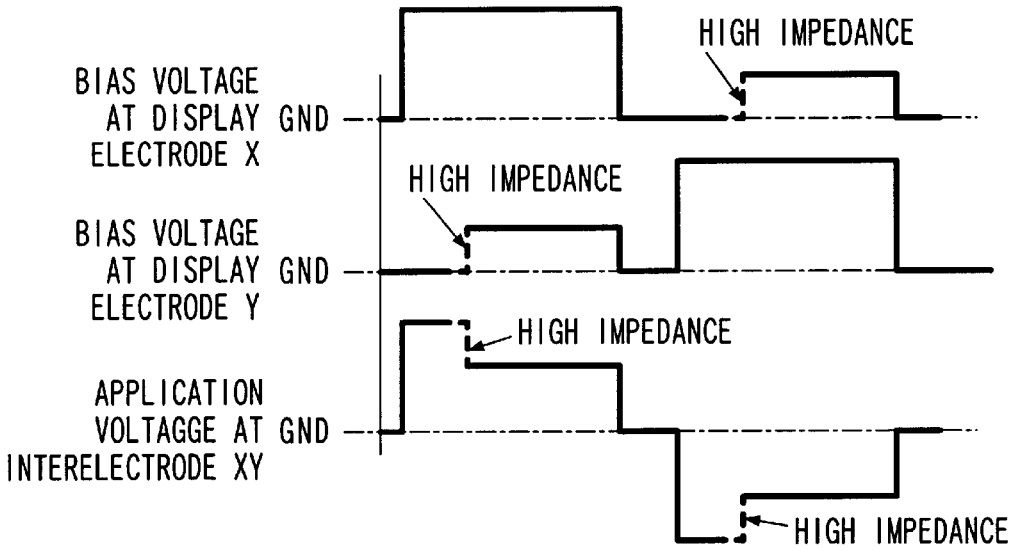
FIG. 11 shows a third example of the drive waveforms.

FIG. 11 shows a third example of the drive waveforms. The drive waveforms in this example have positive high voltage, positive low voltage and the ground level. The positive high voltage is applied to one of the display electrodes. After a short time the other display electrode is separated from the power source to be the high impedance state, and then positive low voltage is applied. These can be replaced with negative low voltage, negative high voltage and the ground level. There are two absolute values of the potential difference except zero volts at the interelectrode XY.

Figure 12:
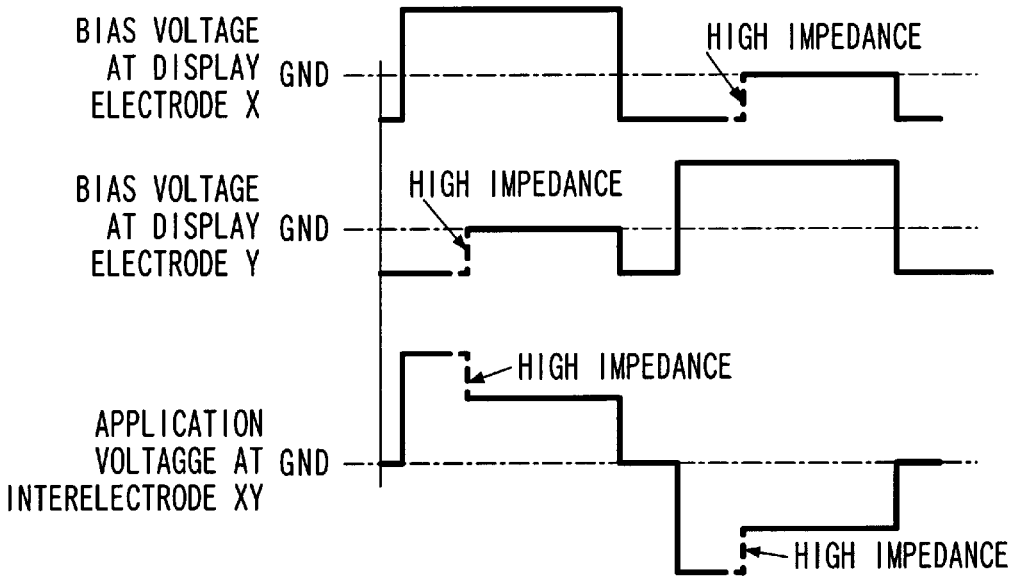
FIG. 12 shows a fourth example of the drive waveforms.

FIG. 12 shows a fourth example of the drive waveforms. This example corresponds to a case where electrode potential setting in the third example is shifted to negative polarity side. These drive waveforms have positive voltage, the ground level and negative voltage. A pair of display electrodes X and Y is set to negative potential simultaneously. After that one of the display electrodes is set to positive potential, and after a short time the other display electrode is set to the high impedance state and then to the ground level. Alternatively, it is possible that the display electrodes X and Y are set to the positive voltage simultaneously, then one of the display electrodes is set to the negative potential, after a short time the other display electrode is set to the high impedance state and then to the ground level. There are two absolute values of the potential difference except zero volts at the interelectrode XY. In this example, compared with the above-mentioned second example, the period between the time of the high impedance state and the previous potential switching time is long, so the request of response to the switching device that is used for the electrode potential control is relieved.

Figure 13:
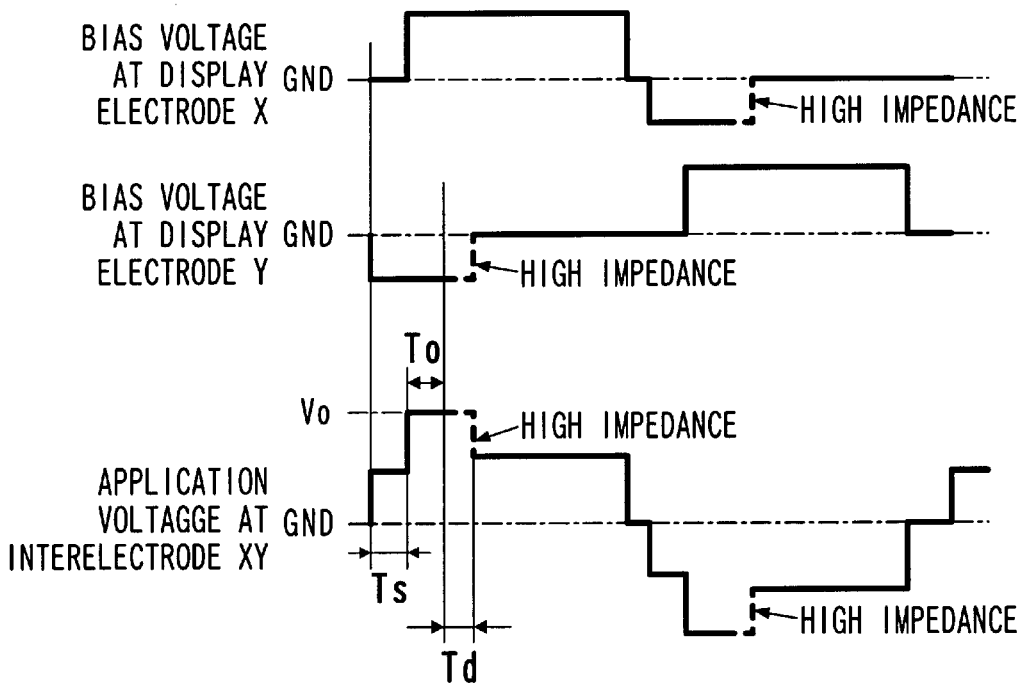
FIG. 13 shows a fifth example of the drive waveforms.

FIG. 13 shows a fifth example of the drive waveforms. The drive waveforms in this example have positive voltage, the ground level and negative voltage. One of the display electrodes is set to negative potential, and then the other display electrode is set to positive potential. After a short time, the display electrode at the negative potential is set to the high impedance state, and then the display electrode at the high impedance state is set to the ground level. Alternatively, it is possible that one of the display electrodes is set to the positive potential, then the other display electrode is set to the negative potential, and after a short time the display electrode at the positive potential is set to the high impedance state, and then the display electrode at the high impedance state is set to the ground level. There are three absolute values of the potential difference except zero volts at the interelectrode XY. Until the polarity of the interelectrode XY voltage is reversed, there is a single pulse. From the leading edge of the pulse, there is a first level, a second level and a third level. Among them, the second level is the maximum voltage. In order to generate display discharge in the high impedance period, the first level must be lower than the third level.

Figure 14:
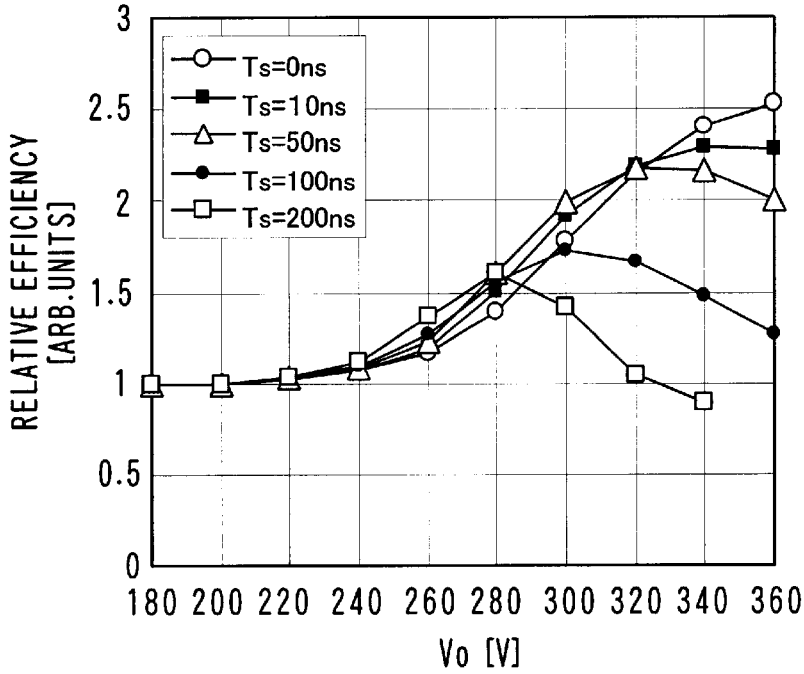
FIG. 14 shows dependence of the efficiency on the voltage Vo in the fifth example of the drive waveforms.

Noting the voltage of the interelectrode XY and comparing this fifth example with the first through fourth examples explained above, the high impedance period is delayed from the leading edge of the pulse. This delay works to adjust the overlap of the display discharge generating time and the high impedance period. FIG. 14 shows dependence of the efficiency on the voltage Vo using the period Ts for keeping the first level as a parameter. As shown in FIG. 14, the fifth example has an advantage that high efficiency can be obtained even if the voltage Vo is low.

Figure 15:
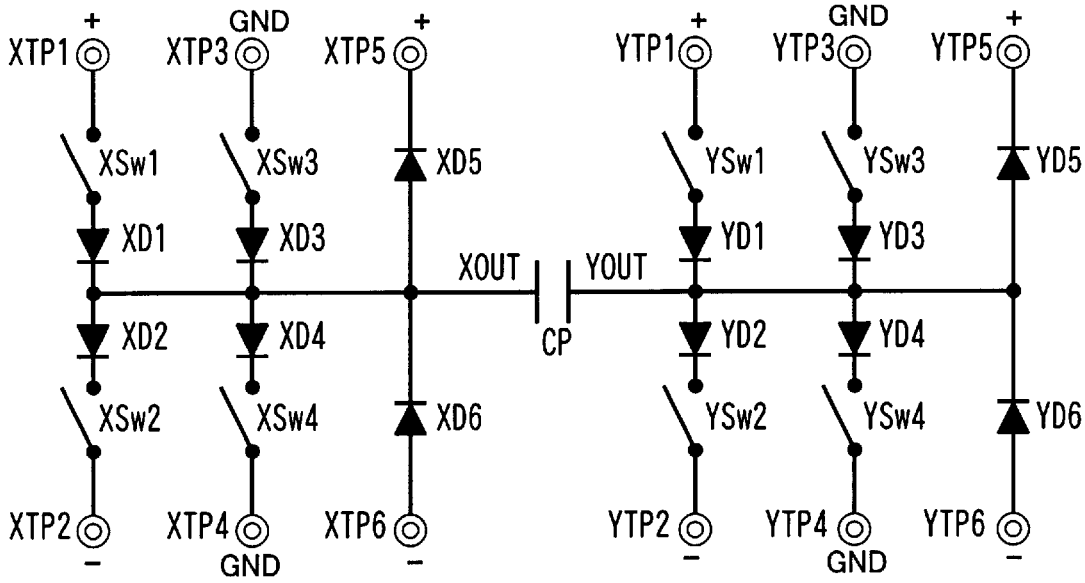
FIG. 15 shows an example of a driving circuit.
Figure 16:
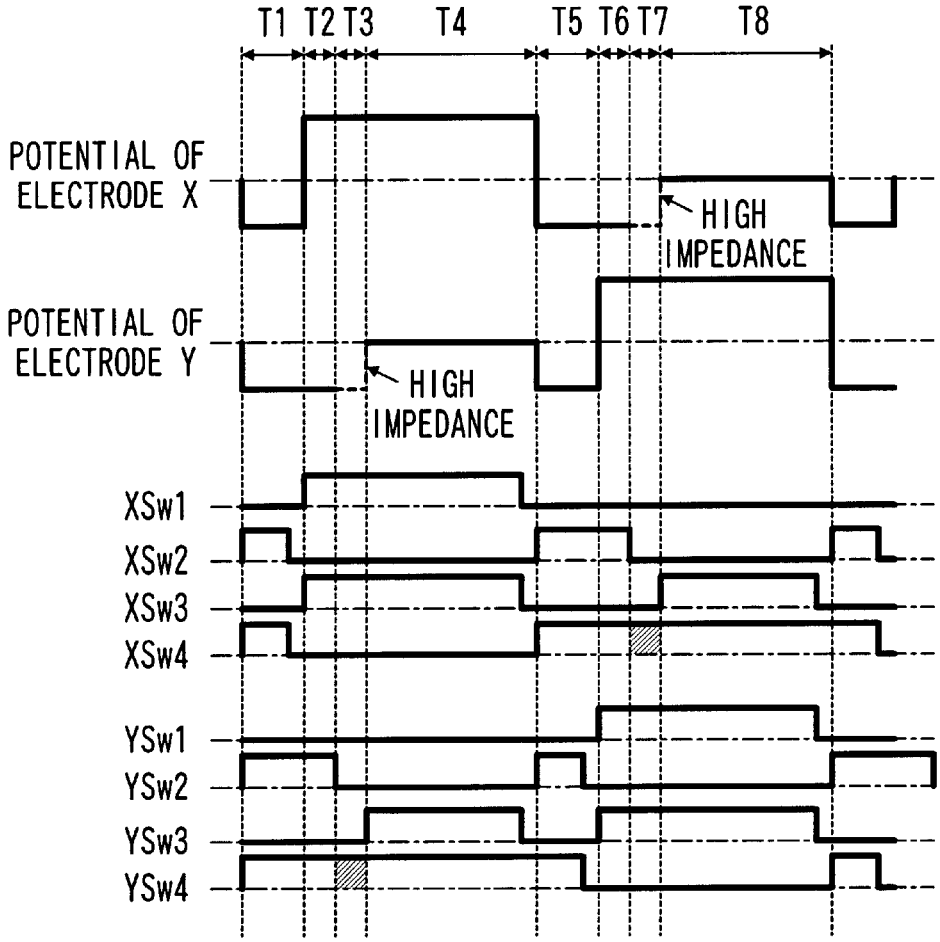
FIG. 16 is a timing chart of switching.
Figure 17:
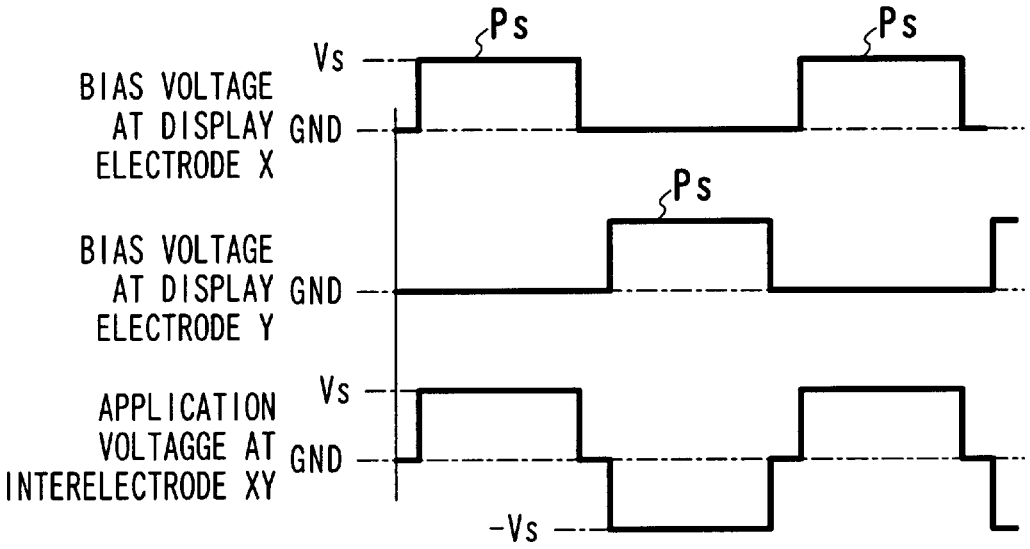
FIG. 17 shows a conventional drive voltage waveform.

FIG. 15 shows an example of the driving circuit. FIG. 16 is a timing chart of the switching. Here, the case of generating the drive waveforms of the fourth example will be explained.

The illustrated circuit includes terminals XTP1 and YTP1 that are connected to the power source for generating the positive voltage, switches XSw1 and YSw1 for switching current path between output terminals XOUT and YOUT connected to the PDP 1 and the terminals XTP1 and YTP1, rectifier elements XD1 and YD1 forming current paths from the switches XSw1 and YSw1 to the output terminals XOUT and YOUT, terminals XTP2 and YTP2 that are connected to the power source for generating the negative voltage, switches XSw2 and YSw2 for switching current paths between the terminals XTP2 and YTP2 and the output terminals XOUT and YOUT, rectifier elements XD2 and YD2 for forming current paths from the output terminals XOUT and YOUT to the switches XSw2 and YSw2, terminals XTP3 and YTP3 that are connected to the ground line, switches XSw3 and YSw3 for switching current paths between the terminals XTP3 and YTP3 and the output terminals XOUT and YOUT, rectifier elements XD3 and YD3 for forming current paths from the switches XSw3 and YSw3 to the output terminals XOUT and YOUT, terminals XTP4 and YTP4 that are connected to the ground line, switches XSw4 and YSw4 for switching current paths between the terminals XTP4 and YTP4 and the output terminals XOUT and YOUT, rectifier elements XD4 and YD4 for forming current paths from the output terminals XOUT and YOUT to the switches XSw4 and YSw4, terminals XTP5 and YTP5 that are connected to the power source for generating the positive voltage, rectifier elements XD5 and YD5 for forming current paths from the output terminals XOUT and YOUT to the terminals XTP5 and YTP5, terminals XTP6 and YTP6 that are connected to the power source for generating the negative voltage, and the rectifier elements XD6 and YD6 for forming current paths from the terminals XTP6 and YTP6 to the output terminals XOUT and YOUT.

In the drive waveforms, a drive period of two pulses is divided into T1, T2, T3, T4, T5, T6, T7 and T8. In the periods T1 and T5, both the display electrodes X and Y are set to the negative potential. In the periods T2 and T6, one of the display electrodes X and Y is set to the positive potential, and the other is set to the negative potential. In the periods T3 and T7, the display electrodes that were set to the negative potential in the period T2 or the period T6 are set to the high impedance state. In the periods T4 and T8, one of the display electrodes X and Y is set to the positive potential, and the other is set to the ground potential.

In the period T1, the switches XSw2 and YSw2 are closed so as to set the output terminals XOUT and YOUT to the negative potential. On this occasion, the switches XSw4 and YSw4 can be either closed or opened. In the period T1 the switches XSw1, XSw3, YSw1 and YSw3 are opened. In addition, the switches XSw2 and XSw4 are opened till the period T2.

In the period T2, the switch XSw1 is closed so as to set the output terminal XOUT to the positive potential. On this occasion, the switch XSw3 for flowing current from the ground line to the output terminal XOUT can be either closed or opened. In the period T2, the switch YSw2 is closed, so the output terminal YOUT is set to the negative potential. The switch YSw4 can be either closed or opened.

In the period T3, the switches XSw1, XSw2, XSw3 and XSw4 maintain the state of the period T2. In the period T3, the switch YSw2 is opened so as to shut off the power supply from the negative power source. In this state, the output terminal YOUT is lower than the ground level. Since the rectifier element YD4 is connected, the output terminal YOUT is set to the high impedance state even if the switch YSw4 is closed. In addition, if discharge is generated in this period T3, potential of the output terminal YOUT rises. If the potential rises largely, potential difference at the interelectrode XY becomes small, and the wall charge cannot be formed sufficiently, resulting in the drive margin failure. In the period T3, the switch YSw4 for flowing current from the output terminal YOUT to the ground line is closed, so as to set potential of the output terminal YOUT below the ground level.

In the period T4, the switches XSw1, XSw2, XSw3 and XSw4 maintain the state of the period T2. The switches YSw3 and YSw4 are closed so as to fix the output terminal YOUT to the ground level.

In the periods T5–T8, the switching is performed with exchanging the relationship between the display electrode X and the display electrode Y in the periods T1–T4.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a PDP by applying a voltage pulse train so as to generate display discharges, a number of times of which corresponds to luminance in cells to be lighted, wherein a drive step of one pulse, to generate a one time display discharge, comprises:

supplying current to a pair of display electrodes of the cells to be lighted from a drive power source so as to charge a capacitance between the display electrodes such that a voltage between the display electrodes exceeds a display discharge start voltage; and cutting off a current path between the display electrode pair and the drive power source at least in a part of a period from a start to an end of the display discharge.

2. The method according to claim 1, wherein the supplying current for charging the capacitance further comprises applying a voltage Vo to the display electrode pair, and applying a voltage lower than the voltage Vo to the display electrode pair, after cutting off the current path.

3. The method according to claim 2, wherein the supplying a current for charging the capacitance further comprises applying a voltage, lower than the voltage Vo, to the display electrode pair and then applying the voltage Vo.

4. The method according to claim 1, wherein the cutting off of the current path further comprises supplying a discharge current to the display electrode pair when a voltage between the display electrodes becomes the sustain voltage or lower.

5. A driving device for applying a voltage pulse train to a PDP so as to generate display discharges, a number of times of which corresponds to luminance in cells to be lighted, wherein the driving device performs a drive operation of one pulse to generate a one time display discharge by supplying current to a pair of display electrodes of the cells to be lighted so as to charge a capacitance between the display electrodes such that a voltage between the display electrodes exceeds display discharge start voltage, and by cutting off a current path to the display electrode pair at least in a part of a period from a start to an end of the display discharge.

6. A display device, comprising:

a surface discharge type PDP, including:

one or more partitions dividing a discharge space in a display screen into plural columns of a matrix display, column spaces defined by the partition, each column space being narrowed periodically along the column direction and being provided with a surface discharge gap at each of wide portions, and plural display electrodes forming electrode pairs for surface discharge, each electrode including a band-like bus portion extending in the row direction of the display screen and plural gap forming portions protruding in the column direction from the bus portion at intersections of the bus portion and the partition; and a driving device to drive the PDP and to apply a voltage pulse train to the PDP so as to generate display discharges, a number of times of which corresponds to luminance in cells to be lighted, wherein the driving device performs a drive operation of one pulse, to generate a one time display discharge, by supplying current to a pair of display electrodes of the cells to be lighted so as to charge a capacitance between the display electrodes such that a voltage between the display electrodes exceeds a display discharge start voltage, and by cutting off a current path to the display electrode pair, at least in a part of a period from a start to an end of the display discharge.

7. The display device according to claim 6, wherein each of the plural gap forming portions is patterned so that opposing sides are not parallel between the gap forming portions of electrodes forming the surface discharge gap.

8. The method according to claim 1, wherein the current path, between the display electrode pair and the drive power source, is cut off in a period including a point in time at which a discharge current has a maximum value of the period from the start to the end of the display discharge.

9. The method according to claim 2, wherein the voltage $V_o$ is from 230 to 380 volts.

10. The method according to claim 3, wherein an application time of the voltage, lower than the voltage $V_o$, is 200 ns or less when supplying current for charging the capacitance.

11. The driving device according to claim 5, wherein:

each of the electrodes of the display electrode pair is connected to a drive power source via a switching element, and the switching element, between the drive power source and at least one electrode of the display electrode pair, is opened so that a current path to the display electrode pair is cut off.

12. A display device comprising a surface discharge type PDP, including:

a display screen with a delta arrangement form in which cells are arranged in a zigzag pattern in both a row direction and a column direction; and a driving device to drive the PDP by applying a voltage pulse train to the PDP so as to generate display discharges, a number of times thereof corresponding to a luminance level in cells to be lighted, wherein the driving device performs a drive operation of one pulse to generate a one time display discharge by supplying current to a pair of display electrodes of the cells to be lighted so as to charge a capacitance between the display electrodes such that a voltage between the display electrodes exceeds a display discharge start voltage, and by cutting off a current path to the display electrode pair, at least in a part of a period from a start to an end of the display discharge.

13. A method for driving a PDP by applying a voltage pulse train so as to generate display discharges, a number of times thereof corresponding to a luminance level in cells to be lighted, wherein a drive operation, in which a potential difference between electrodes forms a waveform of one pulse, producing a one time of display discharge, is generated, comprising:

supplying current from a drive power source to a pair of display electrodes of the cells to be lighted, so as to charge a capacitance between the display electrodes and such that a voltage between the display electrodes exceeds a display discharge start voltage; and cutting off a current path between at least one electrode of the display electrode pair and the drive power source, at least in parts of a period from a start to an end of the display discharge.

14. The method according to claim 13, further comprising:

applying a voltage lower than the applied voltage at the start of the cut-off to the display electrode pair after the cutting off of the current path.

15. The method according to claim 13, wherein the current path, between the display electrode pair and the drive power source is cut off in a period including a point in time at which a discharge current has a maximum value of the period from the start to the end of the display discharge.

16. A driving device applying a voltage pulse train to a PDP so as to generate a display discharges, a number of times of which corresponds to luminance in cells to be lighted, wherein the driving device performs a drive operation in which a potential difference between electrodes forms a waveform of one pulse and a one time display discharge is generated by applying a voltage Vo to a pair of display electrodes of a cell so as to start the display discharge, then by applying a voltage lower than the voltage Vo to the display electrode pair, and by cutting off a current path between at least one electrode of the display electrode pair and a drive power source, at least in a part of a period from a start to an end of the display discharge.

17. The driving device according to claim 16, wherein:

each of the electrodes of the display electrode pair is connected to the drive power source via a switching element; and the switching element, between the drive power source and at least one electrode of the display electrode pair, is opened so that the current path to the display electrode pair is cut off.

18. A display device, comprising a surface discharge type PDP including:

a display screen with a delta arrangement form in which cells are arranged zigzag in both row direction and column direction; and a driving device to drive the PDP by applying a voltage pulse train to the PDP so as to generate display discharges, a number of times thereof corresponding to a luminance level in cells to be lighted, wherein the driving device performs a drive operation in which a potential difference between electrodes forms a waveform of one pulse, producing a one time display discharge, is generated by applying a voltage Vo to a pair of display electrodes of a cell so as to start display discharge, then by applying voltage lower than the voltage Vo to the display electrode pair, and by cutting off a current path between at least one electrode of the display electrode pair and a drive power source, at least in a part of a period from a start to an end of the display discharge.

* * * * *